US012630946B2

(12) United States Patent
Yang et al.

(10) Patent No.: US 12,630,946 B2
(45) Date of Patent: May 19, 2026

(54) FLAME-RETARDANT AND WINDPROOF WADDING AND PREPARATION METHOD THEREOF

(71) Applicants: BEIJING JINLUN WARD TECHNOLOGY CO., LTD, Beijing (CN); BEIJING MIHE TECHNOLOGY CO., LTD, Beijing (CN)

(72) Inventors: Yan Yang, Beijing (CN); Tao Yang, Beijing (CN)

(73) Assignees: BEIJING JINLUN WARD TECHNOLOGY CO., LTD., Beijing (CN); BEIJING MIHE TECHNOLOGY CO., LTD., Beijing (CN)

( * ) Notice: Subject to any disclaimer, the term of this patent is extended or adjusted under 35 U.S.C. 154(b) by 572 days.

(21) Appl. No.: 18/001,533

(22) PCT Filed: Apr. 1, 2022

(86) PCT No.: PCT/CN2022/084906
§ 371 (c)(1),
(2) Date: Dec. 12, 2022

(87) PCT Pub. No.: WO2023/130595
PCT Pub. Date: Jul. 13, 2023

(65) Prior Publication Data

US 2024/0011196 A1 Jan. 11, 2024

(30) Foreign Application Priority Data

Jan. 6, 2022 (CN) ..... 202210008821.4

(51) Int. Cl.
*D01F 1/07* (2006.01)
*D01D 4/08* (2006.01)
(Continued)

(52) U.S. Cl.
CPC ..... *D01F 1/07* (2013.01); *D01D 4/08* (2013.01); *D01F 6/92* (2013.01); *D04H 1/02* (2013.01);
(Continued)

(58) Field of Classification Search
None
See application file for complete search history.

(56) References Cited

U.S. PATENT DOCUMENTS 3,458,905 A * 8/1969 Dodson, Jr. ..... D02J 1/08 57/22
2003/0232555 A1 12/2003 Nobuto et al.
(Continued)

FOREIGN PATENT DOCUMENTS

CN 201520819 * 7/2010
CN 102242406 A 11/2011
(Continued)

OTHER PUBLICATIONS

Machine Translation of CN201520819 (Year: 2010).*
Machine Translation of CN113322577 (Year: 2021).*
Machine Translation of CN209144395 (Year: 2019).*

*Primary Examiner* — Shawn Mckinnon
(74) *Attorney, Agent, or Firm* — JC ONE WORLD

(57) ABSTRACT

The invention provides a flame-retardant and windproof wadding, which is obtained by using a polymer containing an imide ring as a base material and interlacing and compounding it with at least one polyester fiber in a spinning stage; and a preparation method and special equipment thereof. The characteristics and advantages of the present invention are as follows: the flame-retardant and windproof wadding provided by the present invention uses polyimide fiber as the base material and various fibers; through the adjustment of the preparation method and special equipment, the improvement of the windproof, thermal insulation
(Continued)

and flame-retardant effect of the wadding is finally realized; and the same time, various fibers in the wadding are highly mixed, forming a homogeneous, moderately cross-linked and fluffy mixed structure, which can greatly reduce the probability of falling off of the layered structure in the traditional process.

14 Claims, 3 Drawing Sheets

(51) Int. Cl.

| | |
|---|---|
| ***D01F 6/92*** | (2006.01) |
| ***D04H 1/02*** | (2006.01) |
| ***D04H 1/435*** | (2012.01) |
| ***D04H 1/4374*** | (2012.01) |
| ***D04H 1/4382*** | (2012.01) |

(52) U.S. Cl.
CPC ..... *D04H 1/435* (2013.01); *D04H 1/4374* (2013.01); *D04H 1/43835* (2020.05); *D04H 1/43838* (2020.05); *D10B 2201/24* (2013.01); *D10B 2331/04* (2013.01)

(56) References Cited

U.S. PATENT DOCUMENTS

| | | | | |
|---|---|---|---|---|
| 2006/0057373 | A1* | 3/2006 | Inagaki | D04H 1/435 442/361 |
| 2006/0253441 | A1* | 11/2006 | Nelson | G06F 16/38 |
| 2009/0025144 | A1 | 1/2009 | Tanaka et al. | |
| 2012/0273731 | A1* | 11/2012 | Moralez | C08G 73/1014 252/500 |

FOREIGN PATENT DOCUMENTS

| | | | |
|---|---|---|---|
| CN | 108221174 | A | 6/2018 |
| CN | 108823791 | A | 11/2018 |
| CN | 109778424 | A | 5/2019 |
| CN | 209144395 | U | 7/2019 |
| CN | 112111859 | A | 12/2020 |
| CN | 113322577 | A | 8/2021 |
| JP | 2007291570 | A | 11/2007 |

* cited by examiner

FLAME-RETARDANT AND WINDPROOF WADDING AND PREPARATION METHOD THEREOF

CROSS-REFERENCE TO RELATED APPLICATIONS

This application is a U.S. national phase entry of PCT International Phase Application No. PCT/CN2022/084906, filed Apr. 1, 2022, which claims priority to Chinese Patent Application No. CN202210008821.4, filed Jan. 6, 2022. The entire contents of the above referenced applications and of all priority documents referenced in the Application Data Sheet filed herewith are hereby incorporated by reference for all purposes.

FIELD

The invention relates to the technical field of fiber products, in particular to a flame-retardant and windproof wadding and a preparation method thereof.

BACKGROUND

Wadding refers to sheet-type cottons made of plant fibers, animal fibers or chemical fibers for heat preservation, heat insulation or shock resistance. At present, various types of waddings are available in the market, including flame-retardant, windproof, heat preservation, antibacterial ones and so on. In order to achieve the effect of fluffy, porous and lightweight, in the production process of the waddings, a multi-layer (at least 3-layer) structure is often adopted, which needs to be extruded layer by layer and stacked. The production of waddings in this way, on one hand, will lead to a complex production process and low efficiency, and on the other hand, it will increase the possibility of falling off between the structural layers of the waddings, causing the actual effect to fail to meet expectations.

The invention patent of application number 202110758929.0"Wadding with Antibacterial, Flame-retardant and Heat Preservation Function and Preparation Method Thereof" provides an antibacterial, flame-retardant and heat preservation wadding prepared by melt mixing and co-extrusion, but the fibers are poorly mixed and easy to fall off.

The invention patent of application number 201910140874.X "Phase Transformation Insulation Wadding and Preparation Method Thereof". The provided wadding is composed of a moisture-conducting fiber web layer, a heat-storing fiber web layer, and a heat-insulating fiber web layer that are interconnected by non-woven needle punching. However, the distribution between the fiber mesh layers is not uniform, which seriously affects the thermal insulation effect.

The invention patent of the application number 201811023385.8"Permanent Flame-Retardant, Heat Preservation and Carbonized Wadding and Preparation Method Thereof", provides a wadding made from a variety of fibers. However, the wadding still has a layered structure, which not only needs to be opened, but also combed by a carding machine subsequently. The process is complicated, and the layered structure is easy to fall off.

SUMMARY

The purpose of the present invention is to provide a flame-retardant and windproof wadding with good flame-retardant and windproof effect and not easy to fall off through a simple and efficient preparation method.

Above-mentioned purpose of the present invention can be realized by adopting the following technical solution:

The invention provides a flame-retardant and windproof wadding, which is obtained by using a polymer containing an imide ring as a base material and interlacing and compounding it with at least one polyester fiber in a spinning stage.

Further, in the above-mentioned flame-retardant and windproof wadding, the polymer containing an imide ring is a polyimide fiber.

The polyimide fiber has good spinnability and can be made into textiles for various special occasions. Compared with other fibers, it is an excellent thermal insulation material due to its high temperature resistance, flame-retardant property, non-melting droplet property, property of extinguishing right after being deviated from fire and excellent thermal insulation property. As base material of the flame-retardant and windproof wadding, polyimide fiber can effectively interweave with other types of fibers to produce better effects.

Further, in the above-mentioned flame-retardant and windproof wadding, the polyimide fiber is one or more of aliphatic polyimide fiber, semi-aromatic polyimide fiber and aromatic polyimide fiber.

Further, in the above-mentioned flame-retardant and windproof wadding, the degree of polymerization of the polyimide fiber is 20-300.

Preferably, the degree of polymerization may be 20, 50, 100, 150, 200, 250, and 300.

Further, in the above-mentioned flame-retardant and windproof wadding, the polyester fiber is selected from one or more of flame-retardant viscose fiber, flame-retardant polyester fiber, flame-retardant polyester hollow fiber and low melting point composite fiber.

Flame-retardant viscose fiber is usually prepared by adding flame retardant to viscose fiber. It can also be used as a base material for the wadding, and the effect is slightly lower than that of polyimide fiber (mainly due to the poor spinnability of the viscose fiber). However, using polyimide fiber as the base material and adding a certain amount of the flame-retardant viscose fiber can exert the common characteristics of them, further improve the flame-retardant and thermal insulation property of the wadding.

Flame-retardant polyester fiber and flame-retardant polyester hollow fiber are both modified flame-retardant polyester. Both of them have good flame-retardant effect, and in the event of overheating, they only melt and do not burn. They usually have a high limiting oxygen index and are flammable or even flame-retardant materials. However, the traditional flame-retardant polyester has a complicated preparation process and an excessively high addition amount, resulting in extremely high cost. In addition, due to the characteristics of flame-retardant polyester itself, its texture is poor and cannot meet the needs.

The low melting point composite fiber refers to low melting point fiber produced by compounding and spinning of polyester and modified polyester, which can be melted at a lower temperature and bonded with other fibers, and has better adhesion, processability and elasticity than ordinary fibers.

Further, in the above-mentioned flame-retardant and windproof wadding, in parts by weight, the polyimide fiber is 12-28 parts, and the polyester fibers is 38-66 parts.

Preferably, the polyimide fiber is 12 parts, 15 parts, 18 parts, 22 parts, 25 parts, or 28 parts; and the polyester fiber is 38 parts, 45 parts, 50 parts, 55 parts, 60 parts, or 66 parts.

Further, in the above-mentioned flame-retardant and windproof wadding, the polyester fiber comprises, in parts by weight, 27-33 parts of the flame-retardant viscose fiber, 3-13 parts of the flame-retardant polyester fiber, 5-11 parts of the flame-retardant polyester hollow fiber and/or 3-9 parts of the low melting point composite fiber.

Preferably, the flame-retardant viscose fiber is 27 parts, 30 parts, or 33 parts; the flame-retardant polyester fiber is 3 parts, 6 parts, 7 parts, 9 parts, 10 parts, or 13 parts; the flame-retardant polyester hollow fiber is 5 parts, 8 parts, or 11 parts; and the low melting point composite fiber is 3 parts, 6 parts, or 9 parts.

Further, in the above-mentioned flame retardant and windproof flakes, the flame retardant viscose fiber is an organic flame retardant viscose fiber or an inorganic flame retardant viscose fiber, preferably a pyrophosphate-based flame retardant viscose fiber or a silicon-based flame retardant viscose fiber. Burned viscose.

Further, in the above-mentioned flame-retardant and windproof wadding, the limiting oxygen index of the flame-retardant polyester fiber and the flame-retardant polyester hollow fiber is 26-34.

Preferably, the limiting oxygen index is 26, 28, 30, 32, or 34.

Further, in the above-mentioned flame-retardant and windproof wadding, the low melting point composite fiber is a sheath-core structure composite fiber, the melting point of the sheath layer is 110-180° C., and the melting point of the core layer is 250-260° C.

Preferably, the melting point of the sheath layer is 110° C., 130° C., 150° C., or 180° C., and the melting point of the core layer is 250° C., 255° C., or 260° C.

Further, in the above-mentioned flame-retardant and windproof adding, the polyimide fiber has a fineness of 0.5-7 dtex and a length of 25-55 mm; the flame-retardant viscose fiber has a fineness of 1.5-2 dtex and a length of 45-55 mm; the flame-retardant polyester fiber has a fineness of 0.5-2 dtex and a length of 30-35 mm; the flame-retardant polyester hollow fiber has a fineness of 3-4 dtex and a length of 60-70 mm; and the low melting point composite fiber has a fineness of 3-5 dtex and a length of 45-55 mm.

Preferably, the polyimide fiber has a fineness of 0.5 dtex, 1 dtex, 1.5 dtex, 1.67 dtex, 2.22 dtex, 2.5 dtex, 5 dtex, or 7 dtex, and a length of 25 mm, 30 mm, 32 mm, 40 mm, 51 mm, or the flame-retardant viscose fiber has a fineness of 1.5 dtex, 1.67 dtex, or 2 dtex, and a length of 45 mm, 51 mm, or 55 mm; the flame-retardant polyester fiber has a fineness of 0.89 dtex, 1.56 dtex, or 2 dtex, and a length of 30 mm, 32 mm, or 35 mm; the flame-retardant polyester hollow fiber has a fineness of 3 dtex, 3.33 dtex, or 4 dtex, and a length of 60 mm, 64 mm, or 70 mm; and the low melting point composite fiber has a fineness of 3 dtex, 4 dtex, or 5 dtex, and a length of 45 mm, 51 mm, or 55 mm.

More preferably, the specific specifications and proportions of each raw fiber in the flame-retardant and windproof wadding are shown in Table 1 below.

TABLE 1

| Type of polyester fiber | Specification | Proportion | Maximum tolerance |
|---|---|---|---|
| Polyimide fiber | 1.67 detx × 32 mm | 25 parts | ±3 parts |
| | 2.22 detx × 51 mm | 15 parts | ±3 parts |

TABLE 1-continued

| Type of polyester fiber | Specification | Proportion | Maximum tolerance |
|---|---|---|---|
| Flame-retardant viscose fiber | 1.67 detx × 51 mm | 30 parts | ±3 parts |
| Flame-retardant polyester fiber | 0.89 detx × 32 mm | 10 parts | ±3 parts |
| | 1.56 detx × 32 mm | 6 parts | ±3 parts |
| Flame-retardant polyester hollow fiber | 3.33 detx × 64 mm | 8 parts | ±3 parts |
| Low melting point composite fiber | 4.0 detx × 51 mm | 6 parts | ±3 parts |

Further, in the above-mentioned flame-retardant and windproof wadding, the wadding also comprises a bacteriostatic agent and/or a flame retardant.

The flame retardant is preferably a carbon-nitrogen flame retardant or a phosphorus-nitrogen flame retardant.

The bacteriostatic agent is 8121 bacteriostatic agent; and the flame-retardant is 8121 flame retardant or a phosphorus-nitrogen flame retardant.

In order to further enhance the technical advantages of the product, the 8121 bacteriostatic agent and the phosphorus-nitrogen flame-retardant or the 8121 flame retardant can also be added to the flame retardant and windproof wadding provided in the solution of the present invention. Adding the two together in the spinning stage can fully "fix" the bacteriostatic agent and the flame-retardant in the fiber structure of the wadding, and maintain the bacteriostatic and flame retardant effects for a long time. Experiments have verified that its bacteriostatic effect can be increased by about 10-30%, and the duration can be increased by about 60-600%, and the flame retardant effect is increased by about 13%.

The second aspect of the present invention is to provide a special spinning equipment for a flame retardant and windproof wadding. The flame retardant and windproof wadding is the above-mentioned flame retardant and windproof wadding. The special spinning equipment comprises: a spinneret, spinneret orifices arranged on the spinneret and a grid mixing structure arranged outside the spinneret orifices; the special spinning equipment is used for interweaving and compounding in the spinning stage during the preparation of the flame-retardant and windproof wadding.

The main function of the spinneret is to convert the polymer melt or solution through the micro-holes into a stream with a characteristic interface, which is solidified by air cooling or solidification bath to form strips.

The grid mixing structure, after the various fibers are spun, can promote the better compounding of the various fibers and make them achieve an orderly chaotic state. The principle is to use the double-slit or multi-slit interference effect, so that the various fibers can achieve the technical effect of fully compounding while being spun.

Further, in the above-mentioned special spinning equipment for a flame-retardant and windproof wadding, the spinneret orifices are composed of interconnected guide holes and capillary holes, the guide holes are used to introduce melt or solution, and the capillary holes are used to spin streams of the melt or the solution.

Further, in the above-mentioned special spinning equipment for a flame-retardant and windproof wadding, in the spinneret orifices, the geometry of the guide holes is a cone-bottomed cylindrical shape, a conical shape, a hyperbolic shape, two stage cylindrical shape and/or flat-bottomed cylindrical shape; preferably conical shape and/or hyperbolic shape.

The geometry of the guide holes in the spinneret directly affects the melt flow characteristics, thereby affecting the fiber formation. When the melt is extruded from a large space into a small micro-hole, the flow rate increases sharply. In order to control the shear rate of the melt flow and obtain a larger source of pressure difference, it is preferred that the guide holes be conical shape and/or hyperbolic shape. The guide holes of these two shapes can effectively buffer the flow of the melt, make the spinning speed controllable and the spun threads more even, which is convenient for subsequent cross-linking and helps to improve the bulkiness of the mixed fibers.

Further, in the above-mentioned special spinning equipment for a flame-retardant and windproof wadding, the distance between the spinneret orifices is 2-5 cm, and the distance between the spinneret orifices and the grid mixing structure is 1-3 cm.

Preferably, the distance between the spinneret orifices is 2 cm, 3 cm, 4 cm, or 5 cm, and the distance between the spinneret orifices and the grid mixing structure is 1 cm, 2 cm, or 3 cm.

Further, in the above-mentioned special spinning equipment for a flame retardant and windproof wadding, the grid mixing structure is composed of several adjustable grid plates, and the width of the grid plates is 2-5 mm, and the width of the gaps between the grid plates can be adjusted between 2-5 mm.

Preferably, the width of the grid plates is 2 mm, 3 mm, 4 mm, or 5 mm, and the width of the gaps between the grid plates is 2 mm, 3 mm, 4 mm, 5 mm and can be adjusted.

The principle of width adjustment is that the thicker the fibers spun, the larger the width, and the faster the fibers spun, the larger the width.

Further, in the above-mentioned special spinning equipment for a flame-retardant and windproof wadding, the material of the grid mixing structure is the same as the material of the inner wall of the spinneret orifice; the temperature of the grid mixing structure is 65-75% of the temperature in the spinneret orifice, so as to facilitate the dispersion, cooling, interweaving and compounding of the threads spun.

Preferably, the temperature of the grid mixing structure is 65%, 70%, or 75% of the temperature in the spinneret orifice Further, in the above-mentioned special spinning equipment for a flame-retardant and windproof wadding, the grid mixing structure is a structure that can be translated periodically; and the translation period is 1-3 mm/s.

Preferably, the translation period is 1 mm/s, 2 mm/s, or 3 mm/s.

The structure that can be translated periodically can change the area where the interference effect has occurred, forming a more even composite fiber layer macroscopically.

The second aspect of the present invention is to provide a preparation method of a flame-retardant and windproof wadding, the flame-retardant and windproof wadding is the flame-retardant and windproof wadding described above, and the specific operations of the preparation method are as follows:

S1. The polyester fibers are spun and mixed by the special spinning equipment described above to form a mixed fiber layer;

S2. Base material ultrafine fibers of polymer containing an imide ring are spun onto the mixed fiber layer obtained in step S1 to obtain semi-finished wadding;

S3. The semi-finished wadding obtained in step S2 is covered with another layer of the mixed fiber layer to form a sandwich structure of double mixed fiber layers, that is, to obtain the flame-retardant and windproof wadding;

Further, in the above-mentioned preparation method of a flame-retardant and windproof wadding, the operations from step S2 to step S3 are performed at least once.

Preferably, the operations from step S2 to step S3 are performed once, 2 times, or 3 times.

Further, in the above-mentioned preparation method of a flame-retardant and windproof wadding, the polyester fibers are spun at a temperature of 40-80° C.; and the base material ultrafine fibers of polymer are spun at a temperature of 50-70° C.

Preferably, the polyester fibers are spun at a temperature of 40° C., 50° C., 60° C., 70° C., or 80° C.; and the base material ultrafine fibers of polymer are spun at a temperature of 50° C., 60° C., or 70° C.

Further, in the above-mentioned preparation method of a flame-retardant and windproof wadding, the polyester fibers are spun at a speed of 0.20-0.45 m/min; and the base material ultrafine fibers of polymer are spun at a speed of 0.25-0.35 m/min.

Preferably, the polyester fibers are spun at a speed of 0.20 m/min, 0.25 m/min, 0.30 m/min, 0.35 m/min, 0.40 m/min, or 0.45 m/min; and the base material ultrafine fibers of polymer are spun at a speed of 0.25 m/min, 0.30 m/min, or 0.35 m/min.

The characteristics and advantages of the present invention are as follows: the flame-retardant and windproof wadding provided by the present invention uses polyimide fiber as the base material and various fibers; through the adjustment of the preparation method and special equipment, the improvement of the windproof, thermal insulation and flame-retardant effect of the wadding is finally realized; and the same time, various fibers in the wadding are highly mixed, forming a homogeneous, moderately cross-linked and fluffy mixed structure, which can greatly reduce the probability of falling off of the layered structure in the traditional process.

BRIEF DESCRIPTION OF DRAWINGS

In order to illustrate the technical solutions in the examples of the present invention more clearly, the following briefly introduces the accompanying drawings used in the description of the examples. Obviously, the accompanying drawings in the following description are only some examples of the present invention. For those of ordinary skill in the art, other drawings can also be obtained from these drawings without creative effort.

DETAILED DESCRIPTION

Figure 1:
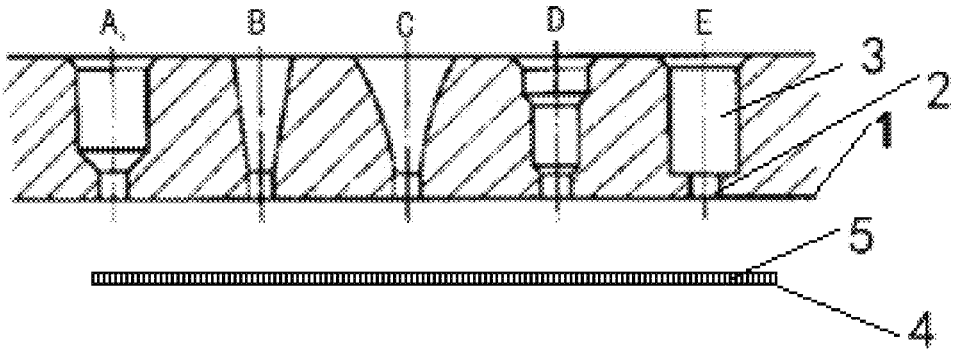
FIG. 1 shows the spinning structure of the special spinning equipment for a flame-retardant and windproof wadding; wherein, 1 is a spinneret, 2 is a capillary hole, 3 is a guide hole (A is a cone-bottomed cylindrical shape, B is a conical shape, C is a hyperbolic shape, D is a two stage cylinder shape, and E is a flat-bottomed cylinder shape), 4 is a grid mixing structure, and 5 is a grid plate.
Figure 2:
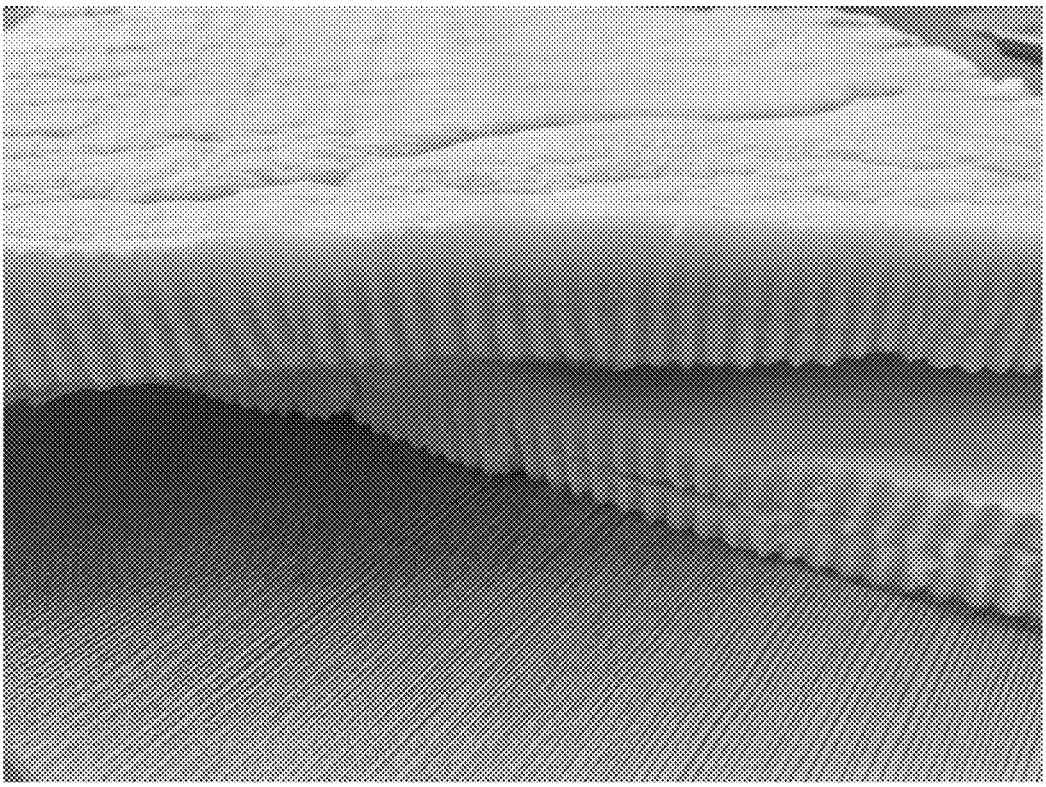
FIG. 2 shows the appearance of the finished product of the flame-retardant and windproof wadding product provided in Example 4 of the present invention.
Figure 3:
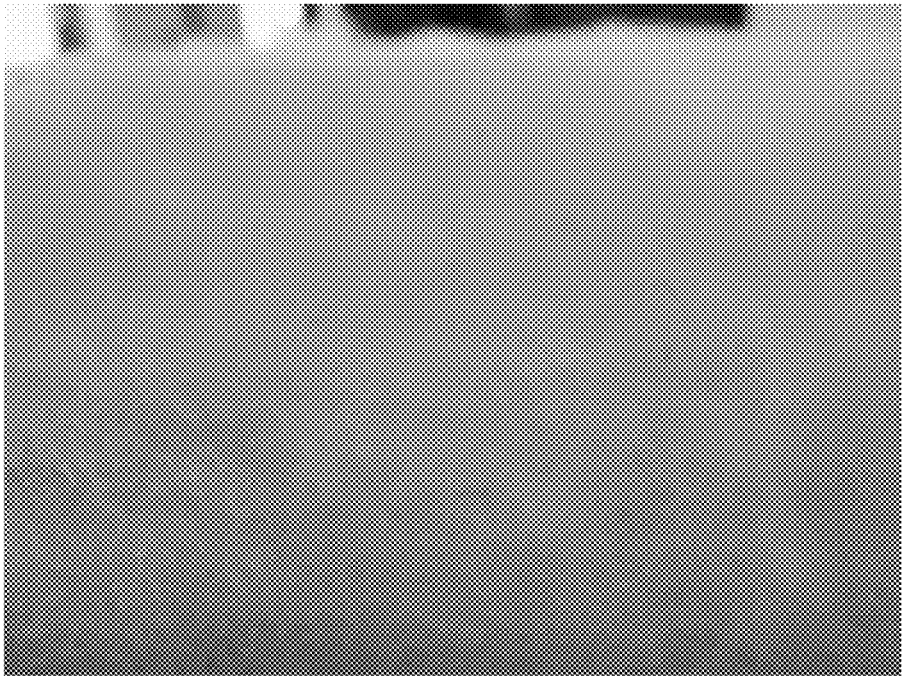
FIG. 3 shows a low magnification view of the internal structure of the flame-retardant and windproof wadding product provided in Example 4 of the present invention.
Figure 4:
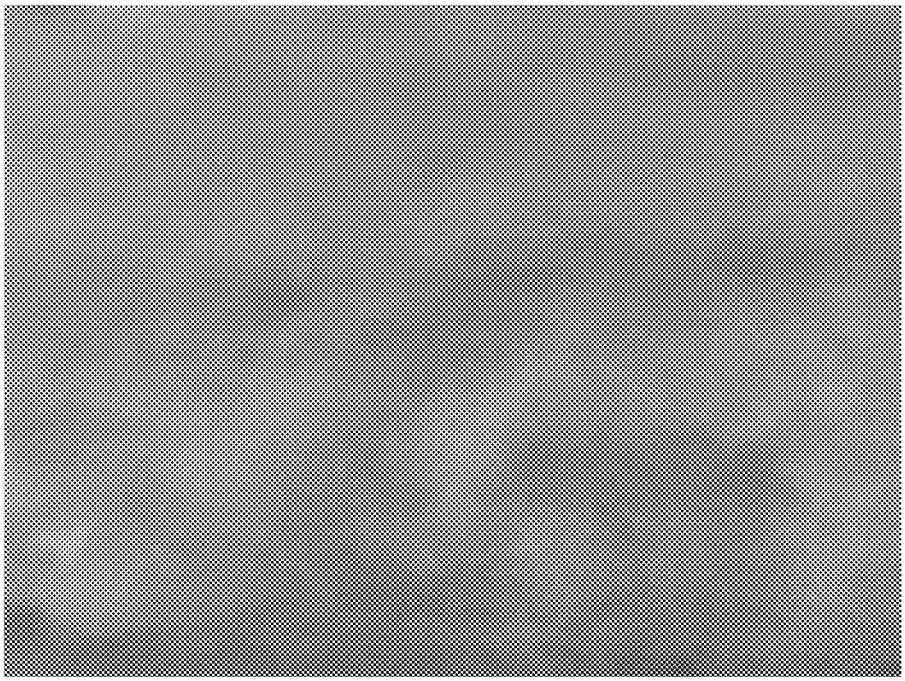
FIG. 4 shows a high magnification view of the internal structure of the flame-retardant and windproof wadding product provided in Example 4 of the present invention.
Figure 5:
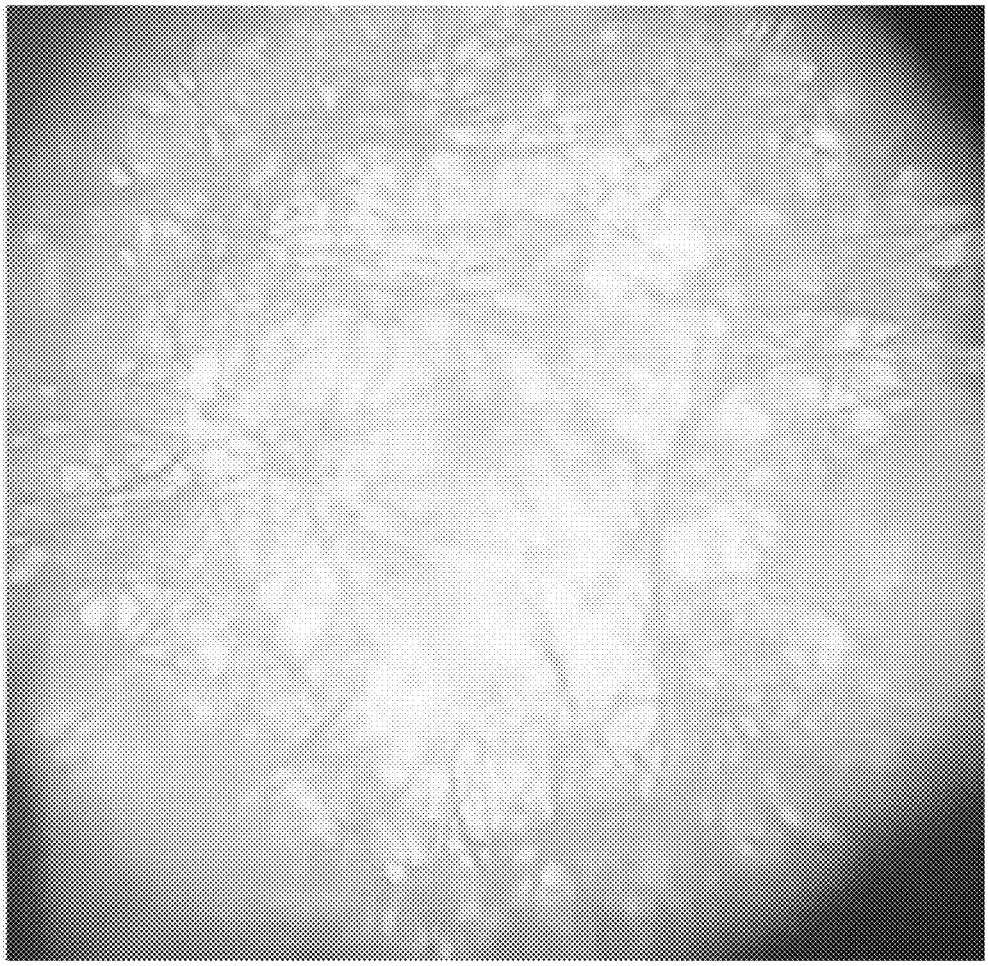
FIG. 5 shows an electron microscope enlarged view of the internal structure of the flame-retardant and windproof wadding product provided in Example 4 of the present invention.

The technical solutions in the examples of the present invention will be clearly and completely described below with reference to the accompanying drawings in the examples of the present invention. Obviously, the described examples are only some, but not all, examples of the present invention. Based on the examples of the present invention, all other examples obtained by those of ordinary skill in the art without creative efforts shall fall within the protection scope of the present invention.

The Raw Material Source Used in the Present Invention:

- Polyimide fiber: purchased from Jiangsu Xiannuo New Material Technology Co., Ltd. or Jilin Gaoqi Polyimide Material Co., Ltd.;
- Flame-retardant viscose fiber: purchased from Beijing Saiolan Flame-Retardant Fiber Co., Ltd., Lanjing Company or Hengtian (Jiangsu) Chemical Fiber Home Textile Technology Co., Ltd.;
- Flame-retardant polyester fiber: purchased from Sinopec Yizheng Chemical Fiber Company;
- Flame-retardant polyester hollow fiber: purchased from Sinopec Yizheng Chemical Fiber Company;
- Low melting point composite fiber: purchased from Hubei Yutao Special Fiber Co., Ltd. and Yizheng Zhongsheng Chemical Fiber Raw Material Co., Ltd.
- Fungicide: 8121 fungicide purchased from Beijing Mihe Technology Co., Ltd.
- Flame retardant: 8121 flame retardant purchased from Beijing Mihe Technology Co., Ltd.

Example 1

A flame-retardant and windproof wadding sheet is obtained by using a polymer containing an imide ring as a base material and interlacing and compounding it with at least one polyester fiber in a spinning stage.

The polymer containing an imide ring is polyimide fiber.

The polyimide fiber is one or more of aliphatic polyimide fiber, semi-aromatic polyimide fiber and aromatic polyimide fiber.

The degree of polymerization of the polyimide fiber is 20-300.

Preferably, the degree of polymerization may be 20, 50, 100, 150, 200, 250, or 300.

The polyester fiber is selected from one or more of flame-retardant viscose fiber, flame-retardant polyester fiber, flame-retardant polyester hollow fiber and low-melting composite fiber.

In parts by weight, the polyimide fiber is 12-28 parts, and the polyester fiber is 38-66 parts.

Preferably, polyimide fiber is 12 parts, 15 parts, 18 parts, 22 parts, 25 parts, or 28 parts; polyester fiber is 38 parts, 45 parts, 50 parts, 55 parts, 60 parts, or 66 parts.

Among polyester fibers, in parts by weight, flame-retardant viscose fiber is 27-33 parts, flame-retardant polyester fiber is 3-13 parts, flame-retardant polyester hollow fiber is 5-11 parts, and/or low-melting composite fiber is 3-9 parts.

Preferably, flame-retardant viscose fiber is 27 parts, 30 parts, or 33 parts; flame-retardant polyester fiber is 3 parts, 6 parts, 7 parts, 9 parts, 10 parts, or 13 parts; flame-retardant polyester hollow fiber is 5 parts, 8 parts, or 11 parts; and low melting point composite fiber is 3 parts, 6 parts, or 9 parts.

The flame-retardant viscose fiber is an organic flame-retardant viscose fiber or an inorganic flame-retardant viscose fiber, preferably a pyrophosphate-based flame-retardant viscose fiber or a silicon-based flame-retardant viscose fiber.

The limiting oxygen index of flame-retardant polyester fiber and flame-retardant polyester hollow fiber is 26-34.

Preferably, the limiting oxygen index is 26, 28, 30, 32, or 34.

The low-melting point composite fiber is a sheath-core structure composite fiber, the melting point of the sheath layer is 110-180° C., and the melting point of the core layer is 250-260° C.

Preferably, the melting point of the sheath layer is 110° C., 130° C., 150° C., or 180° C., and the melting point of the core layer is 250° C., 255° C., or 260° C.

The polyimide fiber has a fineness of 0.5-7 dtex and a length of 25-55 mm; the flame-retardant viscose fiber has a fineness of 1.5-2 dtex and a length of 45-55 mm; the flame-retardant polyester fiber has a fineness of 0.5-2 dtex and a length of 30-35 mm; the flame-retardant polyester hollow fiber has a fineness of 3-4 dtex and a length of 60-70 mm; and the low melting point composite fiber has a fineness of 3-5 dtex and a length of 45-55 mm.

Preferably, the polyimide fiber has a fineness of 0.5 dtex, 1 dtex, 1.5 dtex, 1.67 dtex, 2.22 dtex, 2.5 dtex, 5 dtex, or 7 dtex, and a length of 25 mm, 30 mm, 32 mm, 40 mm, 51 mm, or the flame-retardant viscose fiber has a fineness of 1.5 dtex, 1.67 dtex, or 2 dtex, and a length of 45 mm, 51 mm, or 55 mm; the flame-retardant polyester fiber has a fineness of 0.89 dtex, 1.56 dtex, or 2 dtex, and a length of 30 mm, 32 mm, or 35 mm; the flame-retardant polyester hollow fiber has a fineness of 3 dtex, 3.33 dtex, or 4 dtex, and a length of 60 mm, 64 mm, or 70 mm; and the low melting point composite fiber has a fineness of 3 dtex, 4 dtex, or 5 dtex, and a length of 45 mm, 51 mm, or 55 mm.

More preferably, the specific specifications and proportions of each raw fiber in the flame-retardant and windproof wadding are shown in Table 1 above.

The flame-retardant and windproof wadding also includes a bacteriostatic agent and/or a flame retardant.

The flame retardant is preferably a carbon-nitrogen flame retardant or a phosphorus-nitrogen flame retardant.

The antibacterial agent is 8121 antibacterial agent; and the flame retardant is phosphorus-nitrogen flame retardant or 8121 flame retardant.

The actual product appearance, enlarged view and electron microscope image of the flame-retardant and windproof wadding of the present invention are shown in FIGS. 2 to 5. It can be clearly seen from the figures that various fibers in the wadding are highly mixed, forming a homogeneous, moderately cross-linked and fluffy structure, which can greatly reduce the probability of falling off.

The special spinning equipment for a flame retardant and windproof wadding comprises: a spinneret, spinneret orifices arranged on the spinneret and a grid mixing structure arranged outside the spinneret orifices; the special spinning equipment is used for interweaving and compounding in the spinning stage during the preparation of the flame-retardant and windproof wadding; and the spinning structure is shown in FIG. 1.

The spinneret orifices are composed of interconnected guide holes and capillary holes, the guide holes are used to introduce melt or solution, and the capillary holes are used to spin streams of the melt or the solution.

In the spinneret orifices, the geometry of the guide holes is a cone-bottomed cylindrical shape, a conical shape, a hyperbolic shape, two stage cylindrical shape and/or flat-bottomed cylindrical shape; preferably conical shape and/or hyperbolic shape.

The distance between the spinneret orifices is 2-5 cm, and the distance between the spinneret orifices and the grid mixing structure is 1-3 cm.

Preferably, the distance between the spinneret orifices is 2 cm, 3 cm, 4 cm, or 5 cm, and the distance between the spinneret orifices and the grid mixing structure is 1 cm, 2 cm, or 3 cm.

The grid mixing structure is composed of several adjustable grid plates, and the width of the grid plates is 2-5 mm, and the width of the gaps between the grid plates can be adjusted between 2-5 mm.

Preferably, the width of the grid plates is 2 mm, 3 mm, 4 mm, or 5 mm, and the width of the gaps between the grid plates is 2 mm, 3 mm, 4 mm, 5 mm and can be adjusted.

The material of the grid mixing structure is the same as the material of the inner wall of the spinneret orifice; the temperature of the grid mixing structure is 65-75% of the temperature in the spinneret orifice, so as to facilitate the dispersion, cooling, interweaving and compounding of the spun threads.

Preferably, the temperature of the grid mixing structure is 65%, 70%, or 75% of the temperature in the spinneret orifice.

The grid mixing structure is a structure that can be translated periodically; and the translation period is 1-3 mm/s.

Preferably, the translation period is 1 mm/s, 2 mm/s, or 3 mm/s.

The polyimide fiber base material provided by the present invention is compounded to define the fineness and length specifications of flame-retardant viscose fiber, flame-retardant polyester fiber, flame-retardant polyester hollow fiber and low-melting point composite fiber, thereby obtaining the raw materials for the preparation of wadding. After the raw material is melted, traditional equipment (traditional spinneret orifices) can be used to prepare wadding products, or the special equipment provided by the present invention can also be used to prepare the flame-retardant and windproof wadding. However, the effect of wadding prepared by traditional equipment is slightly worse, because the traditional equipment needs to carry out the operation of mixing threads which is relatively random, and the uniformity of mixed threads cannot be guaranteed. The special equipment for flame-retardant and windproof wadding provided by the present invention is specially designed for random mixing property which improves heat preservation, flame-retardant and windproof effects of the wadding. In the field of wadding production technology, the random mixing of fibers means their homogeneity. The compounded raw material of wadding having a certain viscosity after melting is spun out through the spinneret orifices, and then is preliminarily cooled by the cooling grid. The degree of random mixing between the various fiber materials is effectively improved, the high degree of mixing of various fiber materials is achieved, and a high cross-linking state that cannot be achieved by existing spinning equipment is also achieved. Compared with the existing layered superimposed wadding products, the present invention can effectively increase the adhesion and fixation of the wadding, and greatly reduce the probability of falling off of the whole or a small part of each fiber material in the wadding.

The specific operations of the preparation method of a flame-retardant and windproof wadding are as follows:

S1. The polyester fibers are spun and mixed by the special spinning equipment described above to form a mixed fiber layer;

S2. Base material ultrafine fibers of polymer containing an imide ring are spun onto the mixed fiber layer obtained in step S1 to obtain semi-finished wadding;

S3. The semi-finished wadding obtained in step S2 is covered with another layer of the mixed fiber layer to form a sandwich structure of double mixed fiber layers, that is, to obtain the flame-retardant and windproof wadding.

The operations from step S2 to step S3 are performed at least once.

Preferably, the operations from step S2 to step S3 are performed once, 2 times, or 3 times.

In the preparation method, the polyester fibers are spun at a temperature of 40-80° C.; and the base material ultrafine fibers of polymer are spun at a temperature of 50-70° C.

Preferably, the polyester fibers are spun at a temperature of 40° C., 50° C., 60° C., 70° C., or 80° C.; and the base material ultrafine fibers of polymer are spun at a temperature of 50° C., 60° C., or 70° C.

In the preparation method, the polyester fibers are spun at a speed of 0.20-0.45 m/min; and the base material ultrafine fibers of polymer are spun at a speed of 0.25-0.35 m/min.

Preferably, the polyester fibers are spun at a speed of 0.20 m/min, 0.25 m/min, 0.30 m/min, 0.35 m/min, 0.40 m/min, or 0.45 m/min; and the base material ultrafine fibers of polymer are spun at a speed of 0.25 m/min, 0.30 m/min, or 0.35 m/min.

Example 2

The flame-retardant and windproof wadding uses 25 parts by weight of polyimide fiber with a degree of polymerization of 20 and a specification of 1.67 detx and 32 mm as the base material, and also comprises 27 parts by weight of flame-retardant viscose fiber with a specification of 1.5 detx and 45 mm, 6 parts by weight of flame-retardant polyester fiber with a specification of 0.89 detx and 32 mm, 5 parts by weight of flame-retardant polyester hollow fiber with a specification of 3 detx and 60 mm, and 3 parts by weight of low melting point composite fiber with a specification of 3 detx and 45 mm.

The flame-retardant viscose fiber is a pyrophosphate-based flame-retardant viscose fiber.

The limiting oxygen index of the flame-retardant polyester fiber and the flame-retardant polyester hollow fiber is 26.

The low-melting point composite fiber is a sheath-core structure composite fiber, the melting point of the sheath layer is 110° C., and the melting point of the core layer is 250° C.

The flame-retardant and windproof wadding also comprises 8121 antibacterial agent.

The specific operations of the preparation method of a flame-retardant and windproof wadding are as follows:

S1. The polyester fibers are spun and mixed by the special spinning equipment described above to form a mixed fiber layer, the polyester fibers are spun at a temperature of 40° C., and the polyester fibers are spun at a speed of 0.20 m/min;

S2. Base material ultrafine fibers of polymer containing an imide ring are spun onto the mixed fiber layer obtained in step S1 to obtain semi-finished wadding, the base material ultrafine fibers of polymer are spun at a temperature of 50° C., and the base material ultrafine fibers of polymer are spun at a speed of 0.25 m/min;

S3. The semi-finished wadding obtained in step S2 is covered with another layer of the mixed fiber layer to form a sandwich structure of double mixed fiber layers, that is, to obtain the flame-retardant and windproof wadding.

The special spinning equipment for a flame retardant and windproof wadding comprises: a spinneret 1, spinneret orifices arranged on the spinneret and a grid mixing structure 4 arranged outside the spinneret orifices; and the special spinning equipment is used for interweaving and compounding in the spinning stage during the preparation of the flame-retardant and windproof wadding.

The spinneret orifices are composed of interconnected guide holes 3 and capillary holes 2, the guide holes 3 are used to introduce melt or solution, and the capillary holes 2 are used to spin streams of the melt or the solution.

In the spinneret orifices, the geometry of the guide holes 3 is a cone-bottomed cylindrical shape, a conical shape, a hyperbolic shape, two stage cylindrical shape and/or flat-bottomed cylindrical shape; preferably conical shape and/or hyperbolic shape.

The distance between the spinneret orifices is 2-5 cm, and the distance between the spinneret orifices and the grid mixing structure 4 is 1-3 cm.

The grid mixing structure 4 is composed of several adjustable grid plates 5, and the width of the grid plates 5 is 2-5 mm, and the width of the gaps between the grid plates 5 can be adjusted between 2-5 mm.

The material of the grid mixing structure 4 is the same as the material of the inner wall of the spinneret orifice; the temperature of the grid mixing structure 4 is 65-75% of the temperature in the spinneret orifice, so as to facilitate the dispersion, cooling, interweaving and compounding of the spun threads. The grid mixing structure 4 is a structure that can be translated periodically; and the translation period is 1-3 mm/s.

Example 3

The flame-retardant and windproof wadding uses 15 parts by weight of polyimide fiber with a degree of polymerization of 300 and a specification of 2.22 detx and 51 mm as the base material, and also comprises 33 parts by weight of flame-retardant viscose fiber with a specification of 2 detx and 55 mm, 10 parts by weight of flame-retardant polyester fiber with a specification of 1.56 detx and 32 mm, 11 parts by weight of flame-retardant polyester hollow fiber with a specification of 4 detx and 70 mm, and 9 parts by weight of low melting point composite fiber with a specification of 5 detx and 55 mm.

The flame-retardant viscose fiber is a silicon-based flame-retardant viscose fiber.

The limiting oxygen index of the flame-retardant polyester fiber and the flame-retardant polyester hollow fiber is 34.

The low-melting point composite fiber is a sheath-core structure composite fiber, the melting point of the sheath layer is 180° C., and the melting point of the core layer is 260° C.

The flame-retardant and windproof wadding also comprises phosphorus-nitrogen flame retardant or 8121 flame retardant.

The specific operations of the preparation method of a flame-retardant and windproof wadding are as follows:

S1. The polyester fibers are spun and mixed by the special spinning equipment described above to form a mixed fiber layer, the polyester fibers are spun at a temperature of 80° C., and the polyester fibers are spun at a speed of 0.45 m/min;

S2. Base material ultrafine fibers of polymer containing an imide ring are spun onto the mixed fiber layer obtained in step S1 to obtain semi-finished wadding, the base material ultrafine fibers of polymer are spun at a temperature of 70° C., and the base material ultrafine fibers of polymer are spun at a speed of 0.35 m/min;

S3. The semi-finished wadding obtained in step S2 is covered with another layer of the mixed fiber layer to form a sandwich structure of double mixed fiber layers, that is, to obtain the flame-retardant and windproof wadding.

The special spinning equipment for a flame retardant and windproof wadding comprises: a spinneret 1, spinneret orifices arranged on the spinneret and a grid mixing structure 4 arranged outside the spinneret orifices; and the special spinning equipment is used for interweaving and compounding in the spinning stage during the preparation of the flame-retardant and windproof wadding.

The spinneret orifices are composed of interconnected guide holes 3 and capillary holes 2, the guide holes 3 are used to introduce melt or solution, and the capillary holes 2 are used to spin streams of the melt or the solution.

In the spinneret orifices, the geometry of the guide holes 3 is a cone-bottomed cylindrical shape, a conical shape, a hyperbolic shape, two stage cylindrical shape and/or flat-bottomed cylindrical shape; preferably conical shape and/or hyperbolic shape.

The distance between the spinneret orifices is 2-5 cm, and the distance between the spinneret orifices and the grid mixing structure 4 is 1-3 cm.

The grid mixing structure 4 is composed of several adjustable grid plates 5, and the width of the grid plates 5 is 2-5 mm, and the width of the gaps between the grid plates 5 can be adjusted between 2-5 mm.

The material of the grid mixing structure 4 is the same as the material of the inner wall of the spinneret orifice; the temperature of the grid mixing structure 4 is 65-75% of the temperature in the spinneret orifice, so as to facilitate the dispersion, cooling, interweaving and compounding of the spun threads. The grid mixing structure 4 is a structure that can be translated periodically; and the translation period is 1-3 mm/s.

Example 4

The flame-retardant and windproof wadding uses 20 parts by weight of polyimide fiber with a degree of polymerization of 200 and a specification of 1.95 detx and 42 mm as the base material, and also comprises 30 parts by weight of flame-retardant viscose fiber with a specification of 1.67 detx and 51 mm, 8 parts by weight of flame-retardant polyester fiber with a specification of 1.23 detx and 32 mm, 8 parts by weight of flame-retardant polyester hollow fiber with a specification of 3.33 detx and 64 mm, and 6 parts by weight of low melting point composite fiber with a specification of 4 detx and 51 mm.

The flame-retardant viscose fiber is a pyrophosphate-based flame-retardant viscose fiber.

The limiting oxygen index of the flame-retardant polyester fiber and the flame-retardant polyester hollow fiber is 30.

The low-melting point composite fiber is a sheath-core structure composite fiber, the melting point of the sheath layer is 150° C., and the melting point of the core layer is 255° C.

The flame-retardant and windproof wadding also comprises antibacterial agent and flame retardant, the antibacterial agent is 8121 antibacterial agent; and the flame retardant is phosphorus-nitrogen flame retardant or 8121 flame retardant.

The specific operations of the preparation method of a flame-retardant and windproof wadding are as follows:

S1. The polyester fibers are spun and mixed by the special spinning equipment described above to form a mixed fiber layer, the polyester fibers are spun at a temperature of 60° C., and the polyester fibers are spun at a speed of 0.35 m/min;

S2. Base material ultrafine fibers of polymer containing an imide ring are spun onto the mixed fiber layer obtained in step S1 to obtain semi-finished wadding, the base material ultrafine fibers of polymer are spun at a temperature of 60° C., and the base material ultrafine fibers of polymer are spun at a speed of 0.3 m/min;

S3. The semi-finished wadding obtained in step S2 is covered with another layer of the mixed fiber layer to form a sandwich structure of double mixed fiber layers, that is, to obtain the flame-retardant and windproof wadding.

The special spinning equipment for a flame retardant and windproof wadding comprises: a spinneret 1, spinneret orifices arranged on the spinneret and a grid mixing structure 4 arranged outside the spinneret orifices; and the special spinning equipment is used for interweaving and compounding in the spinning stage during the preparation of the flame-retardant and windproof wadding.

The spinneret orifices are composed of interconnected guide holes 3 and capillary holes 2, the guide holes 3 are used to introduce melt or solution, and the capillary holes 2 are used to spin streams of the melt or the solution.

In the spinneret orifices, the geometry of the guide holes 3 is a cone-bottomed cylindrical shape, a conical shape, a hyperbolic shape, two stage cylindrical shape and/or flat-bottomed cylindrical shape; preferably conical shape and/or hyperbolic shape.

The distance between the spinneret orifices is 2-5 cm, and the distance between the spinneret orifices and the grid mixing structure 4 is 1-3 cm.

The grid mixing structure 4 is composed of several adjustable grid plates 5, and the width of the grid plates 5 is 2-5 mm, and the width of the gaps between the grid plates 5 can be adjusted between 2-5 mm.

The material of the grid mixing structure 4 is the same as the material of the inner wall of the spinneret orifice; the temperature of the grid mixing structure 4 is 65-75% of the temperature in the spinneret orifice, so as to facilitate the dispersion, cooling, interweaving and compounding of the spun threads. The grid mixing structure 4 is a structure that can be translated periodically; and the translation period is 1-3 mm/s.

Design of Verification Experiments:

It can be seen from Examples 2-4 that using polyimide fiber as the base material and four kinds of polyester fibers with certain specifications and proportions can obtain the wadding having the technical effect described in the present invention. Wherein the technical solution claimed in Example 4 is the optimal technical solution of the present invention. In order to demonstrate the superiority of the pretreatment steps and the selected reagents of the detection method of the present invention, the applicant designed more experiments (i.e. examples and comparative examples) by using the technology in Example 4 as a template for certification and comparison.

The standard of the verification experiment, that is, the detection method, is shown in Table 2 below:

TABLE 2

| items | | standard values 120 g/m$^2$ | maximum tolerance | test method |
|---|---|---|---|---|
| mass, g/m$^2$ | | 120 | ±8% | GB/T 242181-2009 |
| bulkiness, cm$^3$/g | | ≥40 | — | FZ/T 64003-2011 |
| compression elastic recovery rate, % | | ≥60 | — | |
| thermal resistance, m$^2$-K/W | | ≥0.30 | — | GB/T 11048-2018 |
| flame-retardant property | after flame time, S | ≤1 | GB/T 5455-2014 | |
| | smoldering time, S | ≤1 | | |
| | damage length, mm | ≤50 | | |
| | phenomenon | no molten drop | | |
| | washability | Washed 3 times with water, no bottom exposed, no obvious damage, no delamination | Washability was in accordance with the 7A procedure in GB/T 8629-2017. The samples were carried out according to the provisions of 6.6 in FZ/T 64003-2011 | |

The key technical factors that can affect the final technical effect of the present invention (quality, thermal resistance, bulkiness, compression elastic recovery rate, flame-retardant property, etc.) involved in the examples and comparative examples include the following aspects:

1. Do not add base material polyester fiber (comparative example 1);
2. The degree of polymerization of the polyimide fiber is 10 (comparative example 2) and 350 (comparative example 3);
3. Polyester fiber is selected from:

1) Single polyester fiber: flame-retardant viscose fiber (Example 5), flame-retardant polyester fiber (Example 6), flame-retardant polyester hollow fiber (Example 7), low melting point composite fiber (Example 8);

2) Two kinds of polyester fibers: flame-retardant viscose fiber+flame-retardant polyester fiber (Example 9), flame-retardant viscose fiber+flame-retardant polyester hollow fiber (Example 10), flame-retardant viscose fiber+low melting point composite fiber (Example 11), flame-retardant polyester fiber+flame-retardant polyester hollow fiber (Example 12), flame-retardant polyester fiber+low-melting point composite fiber (Example 13), flame-retardant polyester hollow fiber+low-melting point composite fiber (Example 14);

3) Three kinds of polyester fibers: flame-retardant viscose fiber+flame-retardant polyester fiber+flame-retardant polyester hollow fiber (Example 15), flame-retardant polyester fiber+flame-retardant polyester hollow fiber+low melting point composite fiber (Example 16), flame-retardant viscose fiber+flame-retardant polyester hollow fiber+low-melting composite fiber (Example 17);
4. The percentage of polyimide fiber is 10% (comparative example 4) and 30% (comparative example 5);
5. The percentage of flame-retardant viscose fiber is 25% (comparative example 6), 35% (comparative example 7);
6. The percentage of flame-retardant polyester fiber is 2% (comparative example 8) and 15% (comparative example 9);
7. The percentage of flame-retardant polyester hollow fiber is 3% (comparative example 10) and 15% (comparative example 11);
8. The percentage of low melting point composite fiber is 2% (comparative example 12) and 10% (comparative example 13).

The setup of the verification experiment is summarized in Table 3 below:

TABLE 3

| | Factor 1 | Factor 2 | Factor 3 | Factor 4 | Factor 5 | Factor 6 | Factor 7 | Factor 8 | Factor 9 | Factor 10 | Factor 11 | Factor 12 | Factor 13 |
|---|---|---|---|---|---|---|---|---|---|---|---|---|---|
| Example 2 | polyimide | 20 | four | 25 parts | 27 parts | 6 parts | 5 parts | 3 parts | 1.67 detx 32 mm | 1.5 detx 45 mm | 0.89 detx 32 mm | 3 detx 60 mm | 3 detx 45 mm |
| Example 3 | polyimide | 300 | four | 15 parts | 33 parts | 10 parts | 11 parts | 9 parts | 2.22 detx 51 mm | 2 detx 55 mm | 1.56 detx 32 mm | 4 detx 70 mm | 5 detx 55 mm |
| Example 4 | polyimide | 200 | four | 20 parts | 30 parts | 8 parts | 8 parts | 6 parts | 1.95 detx 42 mm | 1.67 detx 51 mm | 1.23 detx 32 mm | 3.33 detx 64 mm | 4 detx 51 mm |
| Comparative Example 1 | no | | | | | | | | | | | | |
| Comparative Example 2 | | 10 | | | | | | | | | | | |
| Comparative Example 3 | | 350 | | | | | | | | | | | |
| Example 5 | | single | | | | | | | | | | | |
| Example 6 | | single | | | | | | | | | | | |
| Example 7 | | single | | | | | | | | | | | |
| Example 8 | | single | | | | | | | | | | | |
| Example 9 | | two | | | | | | | | | | | |
| Example 10 | | two | | | | | | | | | | | |
| Example 11 | | two | | | | | | | | | | | |
| Example 12 | | two | | | | | | | | | | | |
| Example 13 | | two | | | | | | | | | | | |
| Example 14 | | two | | | | | | | | | | | |
| Example 15 | | three | | | | | | | | | | | |
| Example 16 | | | three | | | | | | | | | | |
| Example 17 | | | three | | | | | | | | | | |
| Comparative Example 4 | | | | 10 parts | | | | | | | | | |
| Comparative Example 5 | | | | 30 parts | | | | | | | | | |

TABLE 3-continued

| | Factor 1 | Factor 2 | Factor 3 | Factor 4 | Factor 5 | Factor 6 | Factor 7 | Factor 8 | Factor 9 | Factor 10 | Factor 11 | Factor 12 | Factor 13 |
|---|---|---|---|---|---|---|---|---|---|---|---|---|---|
| Comparative Example 6 | | | | | 25 parts | | | | | | | | |
| Comparative Example 7 | | | | | 35 parts | | | | | | | | |
| Comparative Example 8 | | | | | | 2 parts | | | | | | | |
| Comparative Example 9 | | | | | | 15 parts | | | | | | | |
| Comparative Example 10 | | | | | | | 3 parts | | | | | | |
| Comparative Example 11 | | | | | | | 15 parts | | | | | | |
| Comparative Example 12 | | | | | | | | 2 parts | | | | | |
| Comparative Example 13 | | | | | | | | 10 parts | | | | | |

All data in blank parts of Table 3 is as same as that of Example 4 (the most preferred technical effect).

The application effects of each of examples and comparative examples in the verification experiments are summarized in the following Table 4:

TABLE 4

| | | | Compression | Thermal | Flame-retardant Property | | | | |
|---|---|---|---|---|---|---|---|---|---|
| | Mass, g/m$^2$ | Bulkiness cm$^3$/g | Elastic Recovery rate, % | Resistance m$^2$-KW | After Flame Time, s | Smoldering Time, s | Damage Length, mm | Phenomenon of Molten Drop | Washability (prevent falling off) |
| Example 2 | 106.4 | 102.7 | 91.5 | 0.322 | 0 | 0 | 4 | no | washed 3 times with water, no bottom exposed, no obvious damage, delamination, slight pilling |
| Example 3 | 111.3 | 103.5 | 92.7 | 0.302 | 0 | 0 | 5 | no | washed 3 times with water, no bottom exposed, no obvious damage, delamination, slight pilling |
| Example 4 | 62.4 | 116.6 | 93.5 | 0.328 | 0 | 0 | 3 | no | washed 3 times with water, no bottom exposed, no obvious damage, delamination, slight pilling |
| Comparative Example 1 | 151.7 | 36.7 | 53.3 | 0.232 | 2 | 3 | 53 | yes | damaged and delaminated after washed 1 time with water |

TABLE 4-continued

| | Mass, g/m$^2$ | Bulkiness cm$^3$/g | Compression Elastic Recovery rate, % | Thermal Resistance m$^2$-KW | Flame-retardant Property After Flame Time, s | Smoldering Time, s | Damage Length, mm | Phenomenon of Molten Drop | Washability (prevent falling off) |
|---|---|---|---|---|---|---|---|---|---|
| Comparative Example 2 | 125.3 | 77.8 | 60.3 | 0.311 | 1 | 2 | 7.6 | no | washed 1 time with water, slight bottom exposed, slight damage, slight delamination, slight pilling |
| Comparative Example 3 | 130.1 | 80.1 | 66.6 | 0.299 | 1 | 3 | 7.1 | no | washed 1 time with water, slight bottom exposed, slight damage, slight delamination, slight pilling |
| Example 5 | 120 | 91.3 | 69.3 | 0.303 | 0 | 1 | 5.5 | slight | washed 2 times with water, slight bottom exposed, slight damage, delamination, slight pilling |
| Example 6 | 118.3 | 95.4 | 70.5 | 0.305 | 1 | 1 | 5.3 | slight | washed 2 times with water, slight bottom exposed, slight damage, delamination, slight pilling |
| Example 7 | 118.6 | 86.4 | 72.3 | 0.3 | 1 | 0 | 4.9 | slight | washed 2 times with water, slight bottom exposed, slight damage, delamination, slight pilling |
| Example 8 | 117.9 | 83.9 | 66.8 | 0.293 | 1 | 0 | 5.1 | no | washed 2 times with water, slight bottom exposed, slight damage, delamination, slight pilling |
| Example 9 | 113.2 | 99.9 | 76.6 | 0.308 | 0 | 0 | 4.8 | slight | washed 2 times with water, no bottom exposed, slight damage, delamination, slight pilling |
| Example 10 | 112.6 | 101.2 | 78.9 | 0.31 | 0 | 0 | 4.8 | no | washed 2 times with water, no bottom exposed, slight damage, delamination, slight pilling |
| Example 11 | 111.9 | 100.3 | 77.3 | 0.306 | 0 | 0 | 5 | no | washed 2 times with water, no bottom exposed, slight damage, delamination, slight pilling |
| Example 12 | 111.6 | 99.7 | 80.1 | 0.307 | 0 | 0 | 4.7 | no | washed 2 times with water, slight bottom exposed, no damage, delamination, slight pilling |
| Example 13 | 110.9 | 101.1 | 79.6 | 0.311 | 0 | 0 | 4.8 | no | washed 2 times with water, no bottom exposed, slight damage, delamination, slight pilling |
| Example 14 | 111.2 | 100.9 | 80.3 | 0.302 | 0 | 0 | 5 | no | washed 2 times with water, slight bottom exposed, slight damage, delamination, slight pilling |
| Example 15 | 108.6 | 101.6 | 85.6 | 0.311 | 0 | 0 | 4.6 | no | washed 3 times with water, no bottom exposed, slight |

TABLE 4-continued

| | Mass, g/m$^2$ | Bulkiness cm$^3$/g | Compression Elastic Recovery rate, % | Thermal Resistance m$^2$-KW | Flame-retardant Property After Flame Time, s | Smoldering Time, s | Damage Length, mm | Phenomenon of Molten Drop | Washability (prevent falling off) |
|---|---|---|---|---|---|---|---|---|---|
| | | | | | | | | | damage, no delamination, slight pilling |
| Example 16 | 110 | 100.9 | 90.4 | 0.314 | 0 | 0 | 4 | no | washed 3 times with water, slight bottom exposed, slight damage, no delamination, slight pilling |
| Example 17 | 109.1 | 102.1 | 87.3 | 0.308 | 0 | 0 | 4.3 | no | washed 3 times with water, no bottom exposed, slight damage, no delamination, slight pilling |
| Comparative Example 4 | 121.1 | 100.3 | 67.8 | 0.308 | 0 | 1 | 7.2 | no | washed 2 times with water, slight bottom exposed, slight damage, delamination, slight pilling |
| Comparative Example 5 | 119.8 | 99.6 | 66.6 | 0.312 | 0 | 2 | 6.9 | slight | washed 2 times with water, slight bottom exposed, slight damage, delamination, slight pilling |
| Comparative Example 6 | 122.5 | 101.2 | 70 | 0.3 | 1 | 1 | 6.6 | no | washed 2 times with water, slight bottom exposed, slight damage, delamination, slight pilling |
| Comparative Example 7 | 131.4 | 101.5 | 69.3 | 0.297 | 0 | 0 | 5.9 | no | washed 2 times with water, slight bottom exposed, slight damage, delamination, slight pilling |
| Comparative Example 8 | 120.3 | 104.3 | 68.1 | 0.32 | 0 | 1 | 6.4 | no | washed 2 times with water, slight bottom exposed, slight damage, slight delamination, no pilling |
| Comparative Example 9 | 119.9 | 105.2 | 65.9 | 0.314 | 0 | 2 | 7.1 | slight | washed 2 times with water, slight bottom exposed, slight damage, delamination, slight pilling |
| Comparative Example 10 | 120.6 | 111 | 72.5 | 0.307 | 0 | 1 | 7 | no | washed 2 times with water, slight bottom exposed, slight damage, slight delamination, slight pilling |
| Comparative Example 11 | 124.7 | 108.3 | 71.4 | 0.301 | 1 | 1 | 6.3 | slight | washed 2 times with water, slight bottom exposed, slight damage, slight delamination, slight pilling |
| Comparative Example 12 | 122.3 | 100.1 | 69.8 | 0.314 | 1 | 1 | 7.1 | no | washed 2 times with water, slight bottom exposed, slight damage, delamination, no pilling |

TABLE 4-continued

| | Mass, g/m$^2$ | Bulkiness cm$^3$/g | Compression Elastic Recovery rate, % | Thermal Resistance m$^2$-KW | Flame-retardant Property After Flame Time, s | Smoldering Time, s | Damage Length, mm | Phenomenon of Molten Drop | Washability (prevent falling off) |
|---|---|---|---|---|---|---|---|---|---|
| Comparative Example 13 | 120.8 | 99.6 | 70.4 | 0.316 | 1 | 0 | 6.8 | no | washed 2 times with water, slight bottom exposed, slight damage, delamination, slight nilling |

As can be seen from each of examples, comparative examples and application effect detection results of Tables 3-4, 1. From the detection results, embodiment 4 is the best of each index in all examples and comparative examples;
2. Comparative example 1 (no polyimide fiber) is the worst comprehensive index in all examples and comparative examples, which is obviously lower than the standard values given in Table 2, and it is difficult to meet the standard requirements. This fully illustrates that polyimide has played a key role in the present invention;
3. Comparative Examples 2-3, Comparative Examples 4-5, Comparative Examples 6-7, Comparative Examples 8-9, Comparative Examples 10-11, and Comparative Examples 12-13 are respectively optional values out of the scope claimed by each technical point provided by the present invention, and their effects are obviously lower than Examples 2-4.

The applicant entrusted the National Textile Products Quality Supervision and Inspection Center in August 2016, January 2017, and August 2017 to test thermal insulation property of the flame-retardant and windproof wadding of each example described in the present invention according to GB/T 11048-2008 A and B methods. The test items included thermal resistance (m$^2$·K/W), CLO value, converted thermal insulation rate (%) and heat transfer coefficient (W/(m$^2$·K)).

The applicant also entrusted the National Textile Products Quality Supervision and Inspection Center in January 2017 to test the vertical combustion performance of the flame-retardant and windproof wadding of each example of the present invention according to GB/T 5455-2014. The test items included damage length (mm), after flame time (s), smoldering time (s), burning characteristics and the presence of droplets.

The applicant also entrusted the National Textile Products Quality Supervision and Inspection Center in June 2016 to test the product performance of the flame-retardant and windproof wadding of each example described in the present invention according to FZ/T 64020-2011 (composite thermal insulation materials, chemical fiber composite wadding) and FZ/T 73023-2006 (antibacterial knitwear). The test items included compressive elastic rate (%), appearance change after washing, thermal insulation-thermal resistance (m$^2$·K/W), air permeability (mm/s), mass per unit area (g/m$^3$), bulkiness (cm$^3$/g), antibacterial rate (%) for *Staphylococcus aureus* (ATCC 6538) after 50 washes, antibacterial rate (%) for *Candida albicans* (ATCC 10231) after 50 washes, and antibacterial rate (%) for *Escherichia coli* (8099) after 50 washes.

As can be seen from comprehensively comparing the various test results of the flame-retardant and windproof wadding products in the examples provided by the present invention (especially embodiment 4), various indicators such as flame-retardant effect, bulkiness, effect of preventing falling off, heat preservation effect, air-permeable effect, quality and antibacterial rate of the flame-retardant and windproof wadding provided by the present invention are all significantly better than those of the comparative examples and those of existing ones.

Finally, the above embodiments are only used to illustrate the technical solution of the present invention, not to limit it. Although the present invention has been described in detail with reference to the foregoing embodiments, those skilled in the art should understand that the technical solutions described in the foregoing embodiments can be modified, or some or all of the technical features can be equivalently replaced. However, these modifications or replacements do not make the essence of the corresponding technical solutions depart from the scope of the technical solutions of the embodiments of the present invention.

The invention claimed is:

1. A flame-retardant and windproof wadding, characterized in that, the wadding has a sandwich structure of double mixed layers, and the sandwich structure consists of two mixed fiber layers and a polymer containing an imide ring as a base material between the two mixed fiber layers, wherein each of the two mixed fiber layers comprises one or more fibers selected from flame-retardant viscose fiber, flame-retardant polyester fiber, flame-retardant polyester hollow fiber and a composite fiber with a sheath-core structure having a melting point of 110-180° C. of a sheath of the sheath-core structure and a melting point of 250-260° C. of a core of the sheath-core structure, the polymer containing an imide ring is polyimide fiber, in parts by weight, the polyimide fiber is 12-28 parts, and the one or more fibers are 38-66 parts, and the flame-retardant viscose fiber is organic flame-retardant viscose fiber or inorganic flame-retardant viscose fiber; the limiting oxygen index of the flame-retardant polyester fiber and the flame-retardant polyester hollow fiber is 26-34.

2. The flame-retardant and windproof wadding of claim 1, characterized in that, the polyimide fiber has a fineness of 0.5-7 dtex and a length of 25-55 mm; the flame-retardant viscose fiber has a fineness of 1.5-2 dtex and a length of 45-55 mm; the flame-retardant polyester fiber has a fineness of 0.5-2 dtex and a length of 30-35 mm; the flame-retardant polyester hollow fiber has a fineness of 3-4 dtex and a length of 60-70 mm; and the composite fiber with the sheath-core structure has a fineness of 3-5 dtex and a length of 45-55 mm.

3. The flame-retardant and windproof wadding of claim 1, characterized in that, the wadding also includes a bacteriostatic agent and/or a flame retardant.

4. A special spinning equipment for a flame-retardant and windproof wadding, characterized in that, the flame-retardant and windproof wadding is the flame-retardant and windproof wadding of claim 1, and the special spinning equipment comprises: a spinneret, spinneret orifices arranged on the spinneret and a grid mixing structure arranged outside the spinneret orifices; the special spinning equipment is used for interweaving and compounding in the spinning stage during the preparation of the flame-retardant and windproof wadding, wherein in the spinneret orifices, a geometry of guide holes is a cone-bottomed cylindrical shape, a conical shape, a hyperbolic shape, two stage cylindrical shape and/or flat-bottomed cylindrical shape, the grid mixing structure is composed of several adjustable grid plates, and a width of the grid plates is 2-5 mm, a width of gaps between the grid plates can be adjusted between 2-5 mm, and a material of the grid mixing structure is the same as a material of an inner wall of the spinneret orifice; a temperature of the grid mixing structure is 65-75% of a temperature in the spinneret orifice, so as to facilitate dispersion, cooling, interweaving and compounding of spun threads.

5. A preparation method of a flame-retardant and windproof wadding, characterized in that, the specific operations of the preparation method are as follows:

S1. the one or more fibers are spun and mixed by the special spinning equipment of claim 4 to form one of the two mixed fiber layers;

S2. base material ultrafine fibers of the polymer containing an imide ring are spun onto the mixed fiber layer obtained in the step S1 to obtain semi-finished wadding;

S3. the semi-finished wadding obtained in the step S2 is covered with another one of the two mixed fiber layers to form the sandwich structure of double mixed fiber layers, that is, to obtain the flame-retardant and windproof wadding.

6. The flame-retardant and windproof wadding of claim 1, characterized in that, the polyimide fiber is one or more of aliphatic polyimide fibers, semi-aromatic polyimide fibers and aromatic polyimide fibers.

7. The flame-retardant and windproof wadding of claim 1, characterized in that, a degree of polymerization of the polyimide fibers is 20-300.

8. The flame-retardant and windproof wadding of claim 1, characterized in that, each of the two mixed fiber layers comprises, in parts by weight, 27-33 parts of the flame-retardant viscose fiber, 3-13 parts of the flame-retardant polyester fiber, 5-11 parts of the flame-retardant polyester hollow fiber and/or 3-9 parts of the composite fiber with the sheath-core structure.

9. The flame-retardant and windproof wadding of claim 1, characterized in that, the flame-retardant viscose fiber is pyrophosphate-based flame-retardant viscose fiber or silicon-based flame-retardant viscose fiber.

10. The flame-retardant and windproof wadding of claim 3, characterized in that, the flame retardant is carbon-nitrogen flame retardant agent or phosphorus-nitrogen flame retardant.

11. The special spinning equipment for a flame-retardant and windproof wadding of claim 4, characterized in that, the spinneret orifices are composed of the interconnected guide holes and capillary holes, the guide holes are used to introduce melt or solution, and the capillary holes are used to spin streams of the melt or the solution.

12. The special spinning equipment for a flame-retardant and windproof wadding of claim 4, characterized in that, in the spinneret orifices, the geometry of the guide holes is the conical shape and/or the hyperbolic shape; a distance between the spinneret orifices is 2-5 cm, and a distance between the spinneret orifices and the grid mixing structure is 1-3 cm.

13. The special spinning equipment for a flame-retardant and windproof wadding of claim 4, characterized in that, the grid mixing structure is a structure that can be translated periodically; and the translation period is 1-3 mm/s.

14. The preparation method of a flame-retardant and windproof wadding of claim 5, characterized in that, the operations from the step S2 to the step S3 are performed at least once;

the one or more fibers are spun at a temperature of 40-80° C.; the base material ultrafine fibers of the polymer are spun at a temperature of 50-70° C., the one or more fibers are spun at a speed of 0.20-0.45 m/min; and the base material ultrafine fibers of the polymer are spun at a speed of 0.25-0.35 m/min.

* * * * *